US011577137B2

(12) United States Patent
Bartels

(10) Patent No.: US 11,577,137 B2
(45) **Date of Patent: *Feb. 14, 2023**

(54) SPORTS TRAINING SYSTEM

(71) Applicant: Puck Hero, LLC, Bloomington, MN (US)

(72) Inventor: Sean Bartels, Bloomingtoin, MN (US)

(73) Assignee: Puck Hero, LLC, Bloomington, MN (US)

( * ) Notice: Subject to any disclaimer, the term of this patent is extended or adjusted under 35 U.S.C. 154(b) by 344 days.

This patent is subject to a terminal disclaimer.

(21) Appl. No.: 17/010,734

(22) Filed: Sep. 2, 2020

(65) Prior Publication Data

US 2020/0398134 A1 Dec. 24, 2020

Related U.S. Application Data

(63) Continuation of application No. 16/856,836, filed on Apr. 23, 2020, which is a continuation of application No. 16/257,649, filed on Jan. 25, 2019, now Pat. No. 10,668,347.

(60) Provisional application No. 62/622,772, filed on Jan. 26, 2018.

(51) Int. Cl.

| | |
|---|---|
| ***A63B 69/00*** | (2006.01) |
| ***A63B 63/00*** | (2006.01) |
| ***A63B 71/06*** | (2006.01) |

(52) U.S. Cl.

CPC ..... *A63B 69/0026* (2013.01); *A63B 63/004* (2013.01); *A63B 69/0053* (2013.01); *A63B 71/0605* (2013.01); *A63B 71/0619* (2013.01)

(58) Field of Classification Search

CPC ..... A63B 69/0026; A63B 69/004; A63B 69/0053; A63B 71/0619; A63B 71/0605

See application file for complete search history.

(56) References Cited

U.S. PATENT DOCUMENTS

| | | | |
|---|---|---|---|
| 7,166,045 | B1 | 1/2007 | Linner et al. |
| 7,661,679 | B2 | 2/2010 | Mah et al. |
| 9,937,401 | B2 | 4/2018 | Lukongwa |
| 10,668,347 | B2 | 6/2020 | Bartels |
| 2008/0182687 | A1 | 7/2008 | Ahern |
| 2008/0248902 | A1 | 10/2008 | Pittorf |
| 2008/0287224 | A1 | 11/2008 | Salvador et al. |

(Continued)

OTHER PUBLICATIONS

HockeyShot.com [online], "FWD Powershot Hockey Sensor I HockeyShot,", retrieved on Jul. 20, 2017, retrieved from URL <https://www.hockeyshot.com/FWD-Powershot-Hockey-Sensor-p/accessory-061.htm>,7 pages.

(Continued)

*Primary Examiner* — William H McCulloch, Jr.
*Assistant Examiner* — Ankit B Doshi
(74) *Attorney, Agent, or Firm* — Fish & Richardson P.C.

(57) ABSTRACT

A sports training system includes an array of break beam sensors. Each sensor is configured to detect a passage of an object, such as a hockey puck, between adjacent posts and provide information for the passage to a controller communicatively attached to the array of sensors. A mobile application is configured to receive information from the controller and provide, for presentation to a user, passage statistics for the passages completed by one or more players. Servers are located in at least one data center. The servers are configured to receive and store the passage statistics and to provide access to the passage statistics.

20 Claims, 14 Drawing Sheets

(56) References Cited

U.S. PATENT DOCUMENTS

| | | | |
|---|---|---|---|
| 2012/0139727 | A1 | 6/2012 | Houvener et al. |
| 2015/0170530 | A1 | 6/2015 | Damman et al. |
| 2017/0095717 | A1 | 4/2017 | Simonov |
| 2017/0128807 | A1 | 5/2017 | Bohan |
| 2017/0361190 | A1 | 12/2017 | Del Monte |
| 2018/0339210 | A1 | 11/2018 | Linneman |
| 2019/0232138 | A1 | 8/2019 | Bartels |
| 2021/0169417 | A1 | 6/2021 | Burton |

OTHER PUBLICATIONS

Quattriuum.com [online], "Hockey training system; motion tracking and analysis of your power and speed hockey performances", retrived on Jul. 20, 2017, retrieved from URL <http://www.quattriuum.com/en/powershot> 6 pages.

HockeyShot.com [online], "QuickStickz Stickhandling System I HockeyShot", retrieved on Jul. 20, 2017, retrieved from URL <https://www.hockeyshot.com/QuickStickz-Stickhandling-Game-p/stickhandling-aid-012.html>, 16 pages.

SuperDeker.com [online], "SuperDeker Advanced Hockey Training System," 2017, retrieved on Jul. 20, 2017, retrieved from URL <https://www.superdeker.com/>, 11 pages.

SPORTS TRAINING SYSTEM

CLAIM OF PRIORITY

This application is a continuation of U.S. patent application Ser. No. 16/856,836 filed Apr. 23, 2020, which is a continuation of U.S. patent application Ser. No. 16/257,649 filed Jan. 25, 2019, which claims priority to U.S. Provisional Application Ser. No. 62/622,772, filed on Jan. 26, 2018, the entire contents of which are hereby incorporated by reference.

TECHNICAL FIELD

This document generally describes technology for devices and systems used for sports training and competition.

BACKGROUND

Players practice sports to improve their skills and, ultimately, their performance in competition. Players have used any of a variety of devices and other equipment to train and practice. For example, hockey players have used stick handling trainers, which are devices that provide obstacles and other stick handling challenges. Stick handling trainers have taken a variety of forms, for example, including a series of posts that sit on the ground/ice with horizontal bars extending between the posts to define openings through which players stick handle. Stick handling trainers have been non-powered and have relied upon players and their coaches to manually decide upon stick handling drills and to track progress.

SUMMARY

This document generally describes technology for providing devices and systems to improve sports training for players and to permit-training based competitions/comparisons between players. Sports training devices and systems can be provided that include digital processors, sensor arrays, and training instruction devices (e.g., light arrays) to automatically instruct the player on training sequences, track training progress, and provide the ability to compete with other players. For example, a stick handling trainer device can be provided with light arrays on the horizontal bars to identify to the player which opening the player should move the puck through next, sensor arrays positioned within the posts to automatically detect when the player successfully (or unsuccessfully) moves the puck through the target opening, and with wireless networking interfaces to wirelessly transmit results to one or more external devices, such as mobile computing devices (e.g., smartphones, tablet computing devices, wearable computing devices) and/or systems (e.g., cloud based server system). Players can select stick handling sequences to challenge and improve upon their stick handling abilities, and can track their progress over time on a computing user interface that present various graphical user interface features (e.g., charts, graphs, statistical information, analytical information).

Sports training devices and systems can also include features to permit for players to compete with each other, in real time or in a time-delayed manner. For example, multiple sports training devices can be wirelessly networked to each other (locally and/or remotely) and can simultaneously run players through the same training sequences in real time, and can rank the players based on who performs the training sequence (and/or portions thereof) the fastest/slowest. Additionally, a player can train against previously recorded performances for the player or other players on particular training sequences. For example, professional athletes may perform and record their performance on various training sequences, and non-professional athletes (i.e., youth players) can compete against the professional athlete performances. In another example, players can compete against their previous performances. Devices and systems can include features so that players can receive feedback on the progress of other players performing the training sequences, such as differently colored lights on the horizontal bars that are illuminated to represent when other players (in real time or in a previously recorded performance) have progressed through the corresponding opening. Other feedback mechanisms are also possible, such as a ranking tracker that can visually and/or audibly output the players current rank among the players competing.

Sports training devices and systems can additionally provide for rankings among players on various training sequences across one or more groups of players. For example, the results of training sequences for players on a team can be ranked so that players can view their current ranking and progress relative to other members of the team. Other groups of players and rankings can also be provided, such as players within sports associations, geographic areas, leagues, age groups, the entire player-based, and/or other groupings. Such information can effectively gamify sports training—permitting players to continually challenge themselves and each other to improve upon their skill level.

In one implementation, a hockey training apparatus includes a plurality of posts, a plurality of bars, an array of break beam sensors, a plurality of light strips, and a controller. The plurality of bars is supported by the posts. The posts and bars are configured for a puck to passes under each of the bars. The array of break beam sensors can be housed within the posts and configured to detect a passage of the puck under each of the bars between adjacent posts. The plurality of light strips is arranged on the respective bars and operable to be selectively illuminated to indicate one of the bars under which the puck is to pass. The controller is configured to control the light strips and receive signals from the break beam sensors. The controller may include a wireless transceiver to wirelessly receive training sequences from and to wirelessly transmit timing information to a remote device. The training sequences identify sequences of selective light strip activations that are used by the controller to control the light strips. The timing information is determined by the controller based on the signals from the break beam sensors corresponding to those activated during the training sequences.

In some implementations, the apparatus can optionally include one or more of the following features. The controller may provide information of the passage of the puck to a mobile application running on the remote device. The mobile application may provide statistics determined based on the information. In certain embodiments, the controller that includes the wireless transceiver is housed within one of the posts and wirelessly connected to the array of sensors. In certain embodiments, the remote device may be either a mobile computing device or a remote server system. The break beam sensors may include sets of IR emitter and receivers. In some embodiments, at least one of the bars are pivotally connected to at least one of the posts. The posts and the bars may be arranged in a straight configuration or in an arc shape configuration. In some embodiments, the apparatus may further include one or more core bodies rotatably housed in at least one of the posts and configured to mount at least one of the break beam sensors. One of the posts may be engaged with an end portion of a first bar of the bars and an end portion of a second bar of the bars adjacent the first bar. The end portion of the first bar may be fixedly connected to the core body rotatably housed in the one of the posts, and the end portion of the second bar may be fixed connected to the one of the post and movably arranged with respect to the core body. In certain embodiments, the posts may include one or more sensor openings aligned with the break beam sensors, respectively.

In another implementation, a hockey training system includes a remove device and an apparatus. The apparatus includes a plurality of posts, a plurality of bars, an array of break beam sensors, a plurality of light strips, and a controller. The plurality of bars is supported by the posts. The posts and bars are configured for a puck to pass under each of the bars. The array of break beam sensors is housed within the posts and configured to detect a passage of the puck under each of the bars between adjacent posts. The plurality of light strips is arranged on the respective bars and operable to be selectively illuminated to indicate one of the bars under which the puck is to pass. The controller is configured to control the light strips and receive signals from the break beam sensors. The remote device may execute a mobile application configured to receive information of the passage of the puck and provide statistics determined based on the information. The controller may include a wireless transceiver to wirelessly receive training sequences from and to wirelessly transmit timing information to the remote device. The training sequences identify sequences of selective light strip activations that are used by the controller to control the light strips. The timing information is determined by the controller based on the signals from the break beam sensors corresponding to those activated during the training sequences.

In some implementations, the system can optionally include one or more of the following features. The controller including the wireless transceiver may be housed in one of the posts, and wirelessly connected to the array of sensors. The remote device may be either a mobile computing device or a remote server system. The break beam sensors may include sets of IR emitter and receivers. At least one of the bars may be pivotally connected to at least one of the posts. The posts and the bars may be arranged in a straight configuration or in an arc shape configuration. In certain embodiments, the apparatus may further include one or more core bodies rotatably housed in at least one of the posts and configured to mount at least one of the break beam sensors. One of the posts may be engaged with an end portion of a first bar of the bars and an end portion of a second bar of the bars adjacent the first bar. The end portion of the first bar may be fixedly connected to the core body rotatably housed in the one of the posts, and the end portion of the second bar may be fixed connected to the one of the post and movably arranged with respect to the core body. The posts may include one or more sensor openings aligned with the break beam sensors, respectively.

In yet another implementation, a sports training system includes an array of break beam sensors, each sensor configured to detect a passage of an object between adjacent posts and provide information for the passage to a controller communicatively attached to the array of sensors; a mobile application configured to receive information from the controller and provide, for presentation to a user, passage statistics for the passages completed by one or more players; and servers located in at least one data center, the servers configured to receive and store the passage statistics and to provide access to the passage statistics.

Various advantages of the devices and systems can be provided. For example, the system can be programmed or configured to insert gaming tactics to improve the skill level of players and to encourage competition. Analytics can be used to track progress and determine statistics that are used to determine gaming results. Socializing the training experience can create accountability, competition, and motivations.

The details of one or more embodiments are set forth in the accompanying drawings and the description below. Other features and advantages will be apparent from the description and drawings, and from the claims.

DESCRIPTION OF DRAWINGS

Like reference symbols in the various drawings indicate like elements.

DETAILED DESCRIPTION

Figure 1A:
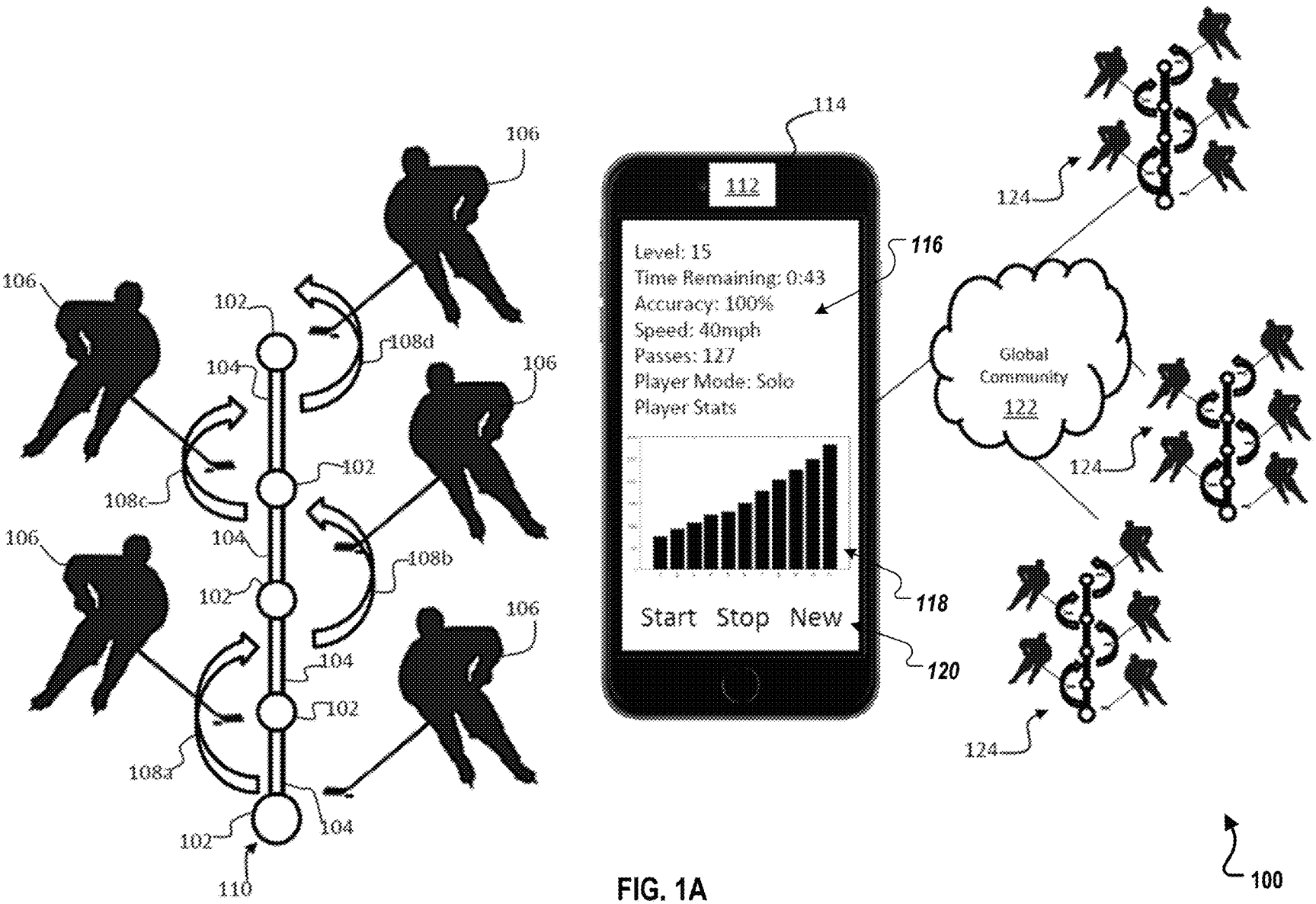
FIG. 1A is a diagram of an example of a sports interaction system.

This document generally describes systems, devices, and techniques for sports training and competition. For example, a sports training system can include an array of break beam sensors. The sensor array can be implemented as a connected series of posts and connecting bars under which passes occur that are detected by the sensors. Each sensor can be configured to detect a passage of an object, such as a hockey puck, between adjacent posts and provide information for the passage to a controller communicatively attached to the array of sensors. A mobile application can be configured to receive information from the controller and can provide, for presentation to a user, passage statistics for the passages completed by one or more players. The system can include or access servers located in at least one data center and configured to receive, store, and provide access to the passage statistics. While examples in the present disclosure pertain to ice hockey, devices and systems of the present disclosure can also be applied to field hockey, soccer, broomball, and other sports. Further, sensors and arms can be replaced with cones or other structured having sensors aimed at each other.

Challenges provided by the system can include challenges associated with time, accuracy, and reaction time. Player performance can be tracked and recorded along each of these dimensions. Additionally, player inaccuracies (e.g., inaccurate shots/stick handling) can be penalized, for example, by adding to an overall time for the player.

The system can gamify, for example in hockey, stick handling drills and practice. The gaming aspect can be accomplished using a sensor array, mobile application (app), and gaming servers. When using the system, a player can pass the puck underneath one of the bars. Each bar can include a series of lights that become illuminated under various conditions, such as to inform the player when and where to pass/stick handle the puck. When a player passes puck under the correct bar, the next bar in a series of bars can light up. The sensor array can detect a passage (or pass) of the puck and can send the information to the app and the gaming servers. Various colors can be used on the lights (e.g., LED array) to visually provide information to the user. For example, a blue light can identify the opening where the player should move the puck, the blue light can be turned to a green light when a correct shot is registered, and a red light can be used to identify instances when the player has moved the puck under the wrong/incorrect bar. Other light colors and/or techniques can be used to provide feedback to the users, including using other colored lights to identify the progress of other players against whom a current player is competing.

The system can include different modes, including at least a solo player modes, practice modes, multiple player modes, coaching/recording modes, and/or other modes. Sensor arrays in configurations of equipment can be synced within the same room when more than one player is involved. Each player can receive the same sequence and can compete against each other. In a teammate mode, multiple arrays can by synced within the same room, and players can be assigned to a sensor array. All players on a team can pass a single puck through each other's array. In a coaching/recording mode, players can select an option to record their own sequences. A team mode, for example, can be designed and used for hockey teams to use as practice tools. Coaches can have access to all the modes. The coaches can also have special access to their team players and can track each player's progress using analytics and resulting statistics. Global ranking of progress by the players can be generated and provided to the players. Awards can be generated based on the results. Analytics can be used to track progress for players.

Player statistics can include, for each player, a player name, a ranking, a current level (for example, selected from numeric levels representing beginners to experts), an accuracy percentage, a speed, a total number of sessions played, a total number of complete passes, a total number of incomplete passes, a number of wins, and a rate of improvement.

Coaching statistics can include, for each coach, a coach name, a team roster, a list of all player names, a lead player, an average accuracy percentage, a total number of sessions played, a total number of complete passes, a total number of incomplete passes, a number of wins, and a rate of improvement.

FIG. 1A is a diagram of an example of a sports interaction system 100. The system 100 includes an array of break beam sensors that are contained in a connected series of posts 102 and bars 104. The posts 102 can serve as support columns for the bars 104, providing a space under each bar 104 under which a sports-related object, for example a hockey puck, can be passed. Light strips (e.g., LED light strips) on the bars 104 can be illuminated to direct players to a next pass. Each sensor (e.g., infrared (IR) sensor array including an IR emitter and receiver, laser-based sensor arrays) can be configured to detect a passage of an object between adjacent posts and provide information for the passage to a controller communicatively attached to the array of sensors. For example, the passage of the object can be the passing of a hockey puck by player 106.

In one example of a series of passes/stickhandling of the hockey puck, the passes can include a sequence of puck movements that occur in an order indicated by arrows 108*a*-108*d*, which are identified to the user by lights on the bars 104 being illuminated. In this example, the player 106 linearly stick handles the puck under the bars 104 from one end to the other end, but the players 106 can be instructed to perform other non-linear stick handling sequences by illuminating the lights on the bars 104 in a different order. For example, the light on the bar 104 at a first end could be illuminated and then the light on the bar 104 at the other end could be illuminated, and this could repeat several times to provide training sequence for the player 106 (and without having the players 106 stick handle under the other bars 104 in the middle). Other sequences are also possible, including player and/or coach recorded sequences, which can be shared with other players.

In some implementations, the training sequence (order with which the lights on the bars 104 are illuminated) can start after one of the player 106 taps (for example, with a stick) a start button 110 on a first post 102 in the series. Tapping the start button 110 can initiate a training session or a competitive game. Other mechanisms for starting a training session are also possible, such as providing verbal commands to an audio user interface, activating a button on a mobile computing device, and/or detecting other verbal and/or physical actions by the player. In some implementations, the controller that communicates with sensors that can be embedded in the posts 102 or can be contained in one or more of the posts 102. Using the system 100, one to four players in the same room (or players competing remotely) can go head-to-head in a practice or a competitive game.

An application 112 (for example, a mobile application) can be configured to receive information from the controller connected to the sensory array and included in, for example, the post 102, and can provide, for presentation to a user, passage statistics for the passages (or passes) completed by one or more player 106. For example, the statistics can be presented, by the application 112, for presentation on a device 114, such as a mobile device (for example, a mobile phone or smart phone). The statistics can include textual statistics 116 and graphical statistics 118 that can depict, for example, historical improvements of a team (or a player) over time. In some implementations, the application 112 can also provide statistics and other information in audio format. The device 114 can use a Bluetooth or near-field communication (NFC) technology to connect to the series of posts 102 and bars 104 that form a physical device for practice or gaming.

Statistics presented by the application 112 can include, for example, a current skill level of the players (indicating how fast lights are cycled for a sequence of shots), a player (or team) ranking relative to other players (or teams), a time remaining in a current session, an accuracy percentage of shots taken by the player (or team), an average (or maximum) speed of shots taken (how fast the puck moves), a total number of passes, a player mode (for example "solo" for an individual player or "team" for a team of players), and player statistics (for example, that can be provided graphically). In some implementations, a "player stats" control can be provided by which additional or detailed player stats can be displayed.

In some implementations, the application 112 can include controls 120 that are selectable by the user using the device 114 to perform certain actions. A "start" control can be used to start a session in which the player 106 are participating, such as a competitive session that has just been initiated. Selecting the "start" control can trigger a message that is played on a nearby player's phone that serves as the device 114. A "stop" control can be used to end a current session. A "new" control can indicate that a new session is to be initiated. Other controls 120 are possible, such as to allow the user to switch between modes of the application 112.

The system 100 includes servers that are located in at least one data center. The servers can be configured to receive and store the passage statistics and to provide access to the passage statistics. For example, the servers can support a global community 122 of other players 124 that may be in competition with a team that includes the player 106. Teams (or single players) can compete, for example, when configurations of the system 100 are the same, such as when the posts 102 and the bars 104 are arranged in a straight line configuration, as shown in FIG. 1A.

Figure 1B:
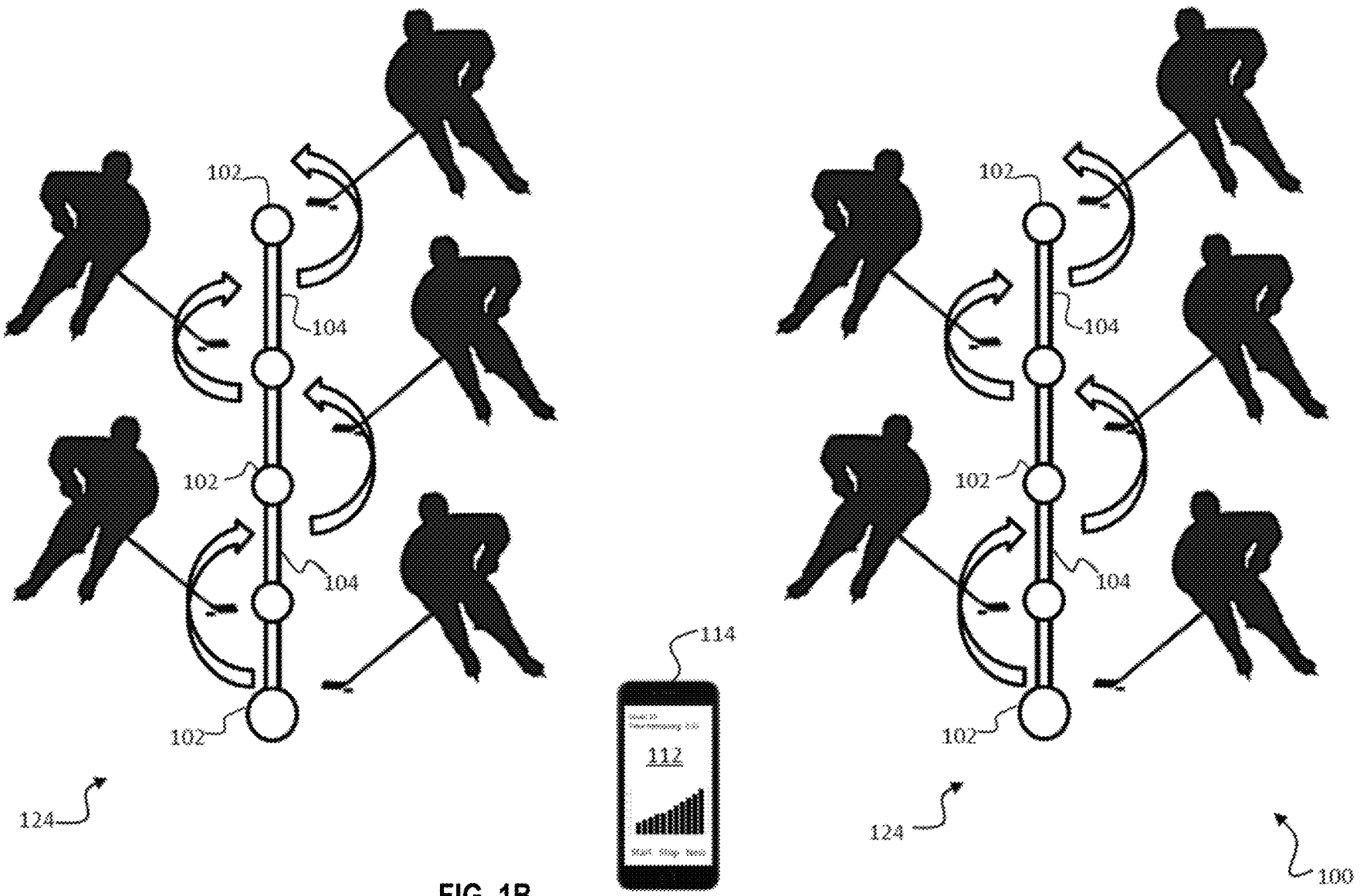
FIG. 1B is a diagram showing an example of a competition between two players.

FIG. 1B is a diagram showing an example of a competition between two players 124. The application 112, as shown in FIG. 1B, can display current statistics and other information for one or both sessions being performed by the players 124. The information displayed by the application 112 can include real-time or near-real-time updates. For example, controllers can receive information from sensors in the posts 102 when shots occur between specific posts and under the bars 104.

Figure 2A:
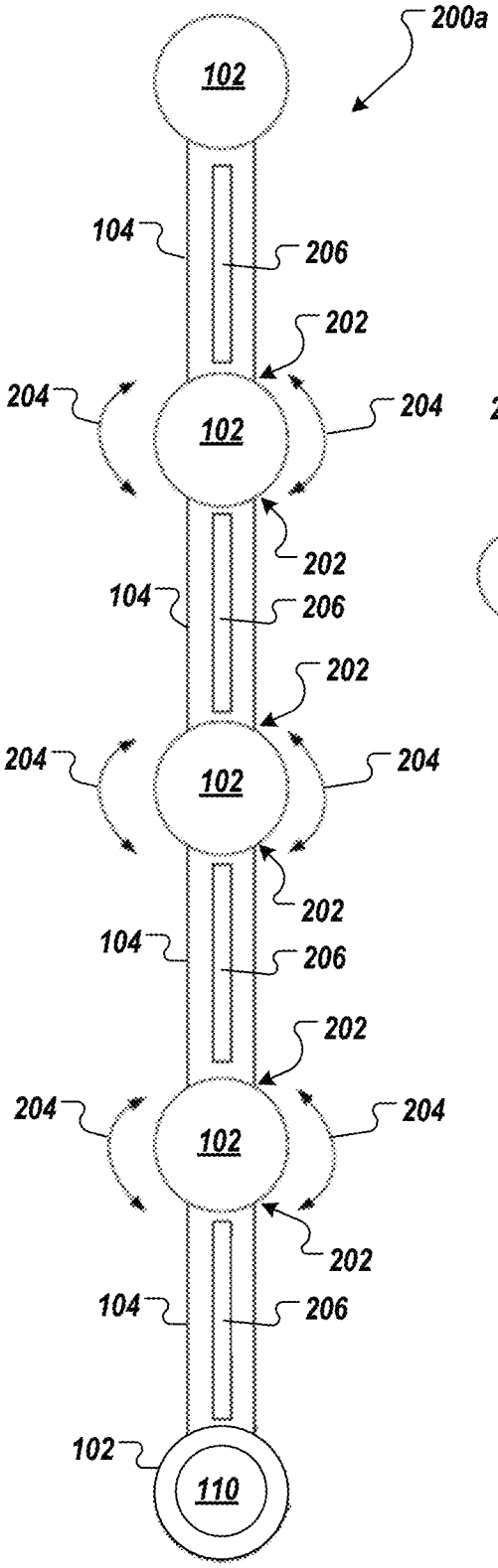
FIG. 2A is a top view diagram of a straight line configuration of posts and bars.
Figure 2B:
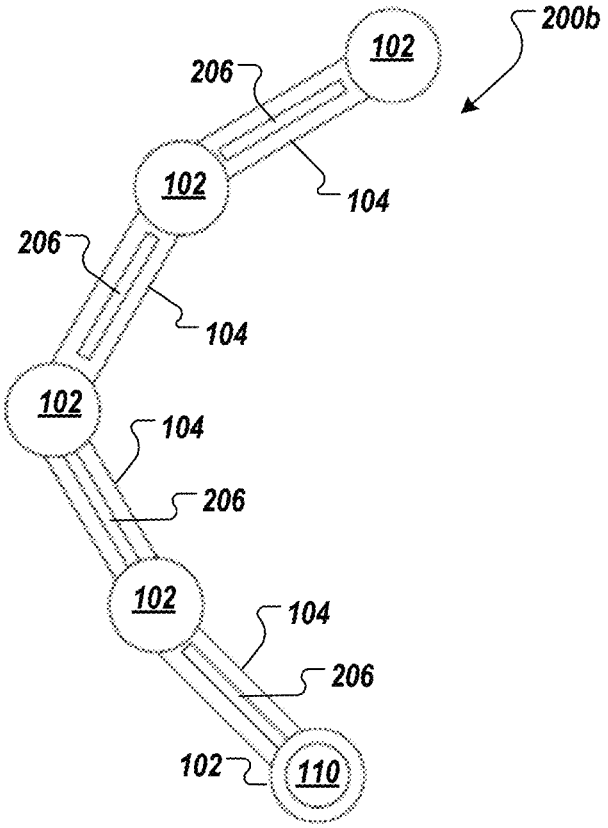
FIG. 2B is a top view diagram of an arc shape configuration of posts and bars.
Figure 2C:
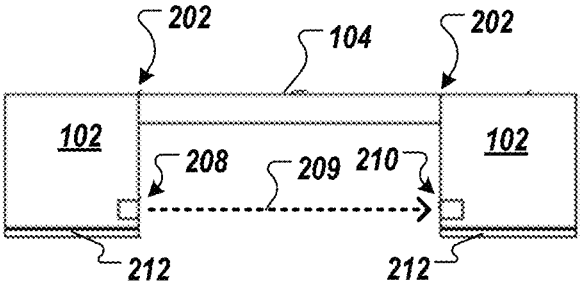
FIG. 2C is a side view diagram of two posts and a connecting bar.
Figure 2D:
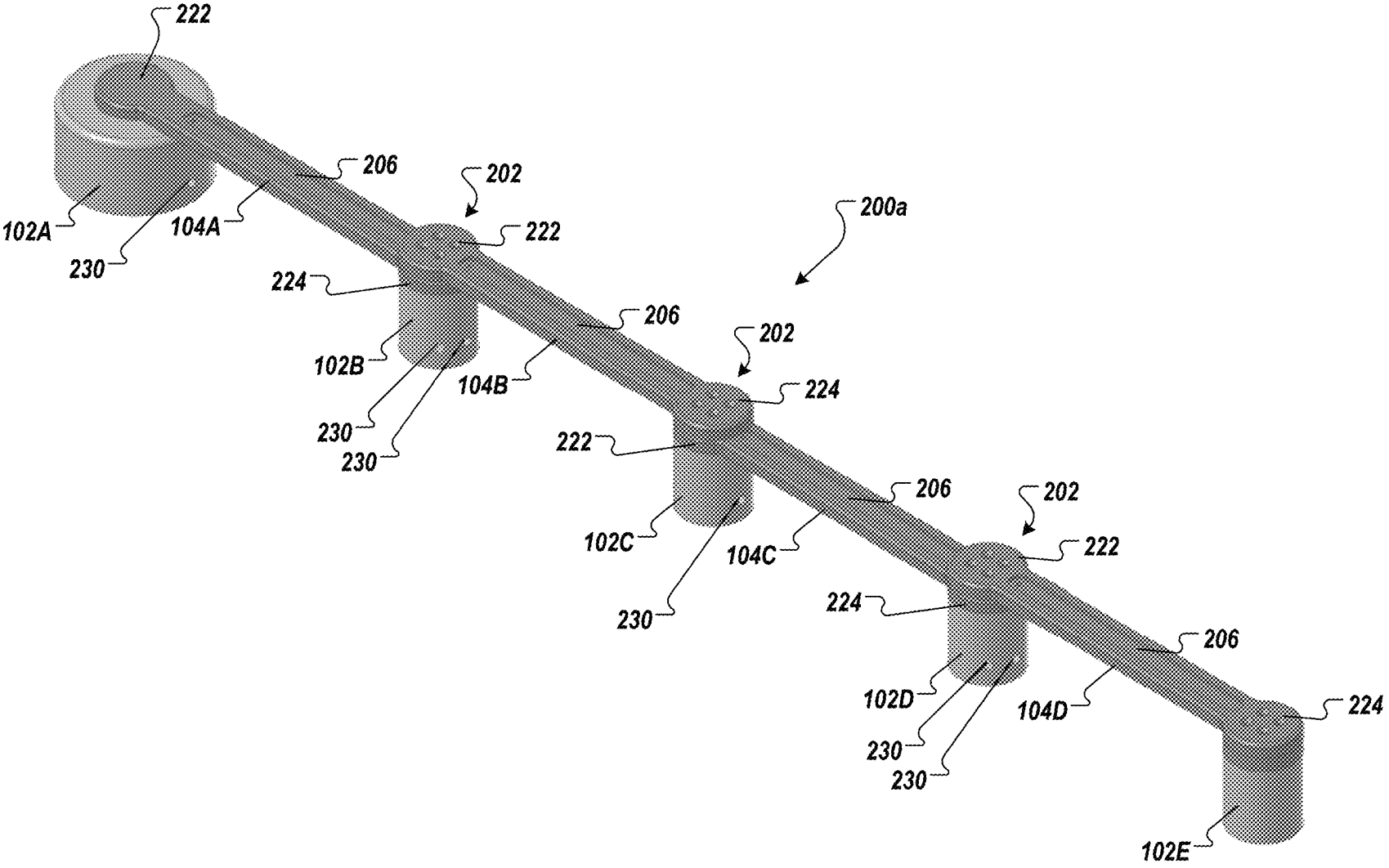
FIG. 2D is a perspective view of example posts and bars in a straight line configuration.

Referring to FIGS. 2A and 2D, a straight line configuration 200*a* of posts 102 and bars 104 is described. FIG. 2A is a top view diagram of a straight line configuration 200*a* of posts 102 and bars 104, and FIG. 2D is a perspective view of the posts 102 and the bars 104 in the straight line configuration 200*a*. The straight line configuration 200*a* matches the configurations in FIGS. 1A and 1B. The posts 102 can serve as support columns for the bars 104.

Each post 102 can be approximately five inches in diameter and can house electronics and wiring used by the controller and to provide power to lights. Bars 104 (or top bars) can have a length, for example of 12 to 15 inches and a width, for example, of three inches. The bars 104 can also include electronics and wiring as needed. The bars 104 can be pivotally mounted to the posts 102, which can permit them to be articulated in a variety of different angles relative to each other and also for the entire array of bars 104 to be collapsed/folded so that it can be readily transported. For example, the bars 104 can be collapsed/folded so that the bars 104 are adjacent to each other lengthwise and so that the collapsed array has approximately the length of one of the bar 104.

Figure 2E:
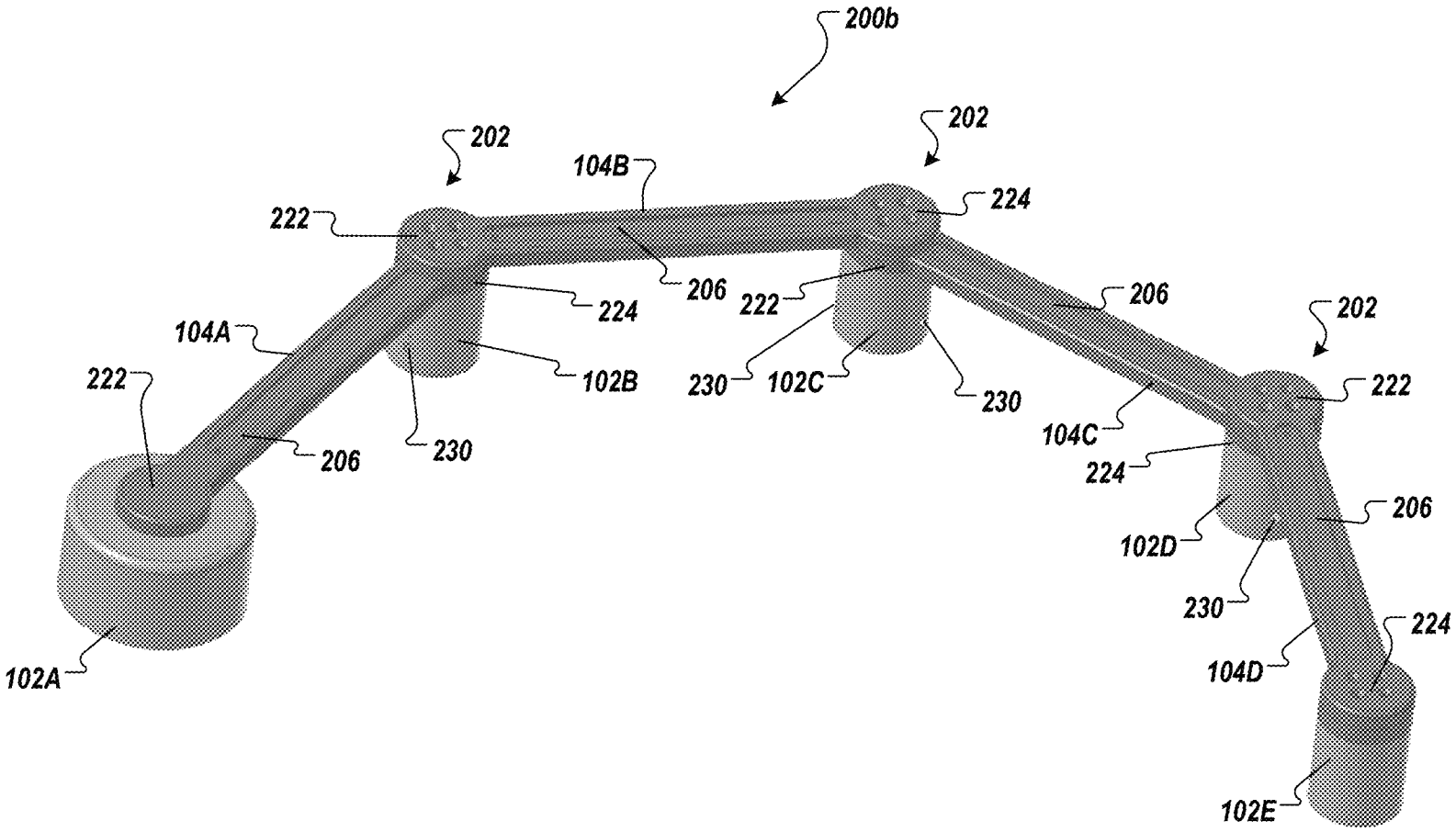
FIG. 2E is a perspective view of the posts and bars in an arc shape configuration.

Referring to FIGS. 2B and 2E, an arc shape configuration 200*b* of posts 102 and bars 104 is described. FIG. 2B is a top view diagram of an arc shape configuration 200*b* of posts 102 and bars 104, and FIG. 2E is a perspective view of the posts 102 and the bars 104 in the arc shape configuration 200*b*. Pivot joints 202 can be configured to allow for changing the configuration of the posts 102 and the bars 104 of the system 100. For example, creating the arc shape configuration 200*b* can be accomplished by bending the straight line configuration 200*a* including physically pulling a pair of bars 104 at a pivot joint 202 relative to an intervening post 102. The bending can occur at the pivot joints 202, and an angle formed by adjacent bars 104 can be changed, as indicated by arrows 204. Configurations can be locked into place, such as by using a locking mechanism on each of the posts 102. Configurations can also be standardized, such as by limiting angles at the pivot joints to specific positions at which locking can occur. At each pre-determined angle, the system 100 can detect the angle and record the information, which can be used to compare and set angles of configurations for competing players or teams. For example, angle information for a given pivot joint 202 can be displayed on one or both of the posts 102 and the application 112, and a light or a message can be displayed when the angles are set correctly.

In some implementations, multiple configurations of the four (or some other number of) bars 104 depicted in FIG. 1A can be interconnected. For example, long straight configurations can be created to produce long training and gaming experiences. Curved configurations, including circles and ovals, can provide additional variety. In some implementations, longer lengths of the bars 104 can be used, for example, for long, straight-line training and passing at high speeds.

Referring again to FIG. 2A, each bar 104 can include a light strip 206 (for example, light-emitting diodes (LEDs)). In some implementations, the light strip can include lights for different purposes, such as to signal the particular bar 104 under which the next shot is to occur, or to provide a display signaling confirmation of a completed shot. As such, there can be multiple LED strips on each bar 104. In some implementations, a series of lights can be used to indicate the position of the next shot and one or more shots after that one.

The sequence of lights that are lit need not be in order physically, such as moving from one bar 104 to the next bar 104, but can instead be programmed or randomized so as to add variety and challenge to a practice or a competition. Re-programmed or randomized light sequences can be used, for example, to test the speed and accuracy of players.

Individual players (and teams of players) can compete with each other or compete with their previous times or other statistical measures, such as speed and accuracy. Combinations of lights can be used to indicate a competitor's current progress or to indicate a player's (or team's) time to beat.

FIG. 2C is a side view diagram of two posts 102 and a connecting bar 104. The side view shows a sensor send 208 that can send a signal 209, such as an infra-red (IR) beam or a laser to a sensor receive 210. When a passed hockey puck, for example, interrupts the signal, the controller can detect that a shot has occurred. The information that is captured can include an identification of the particular bar 104 under which the hockey puck, for example, has passed. The information can also include a time at which the event has occurred. In some implementations, the sensor send 208 and the sensor receive 210 can determine a speed of the shot as well as other information.

Interchangeable feet 212 can be attached at the bottom of the posts 102. Different surfaces or sides of the interchangeable feet 212 can be used for different conditions, such as for icy or dry surfaces. For example, a rubber or other non-skid surface can be used on a hard, dry surface. A spiked or pointy side on the interchangeable feet 212 can be used on ice. In some implementations, the surface of the interchangeable feet 212 can be changed by removing and flipping the interchangeable feet 212 to another side that is more suitable for a surface being used.

Referring to FIGS. 2D and 2E, the posts 102 (including 102A, 102B, 102C, 102D, and 102E) are configured to pivotally support end portions of the bars 104 (including 104A, 104B, 104C, and 104D). Each of the bars 104 is configured as an elongated body with opposite first and second ends portions 222 and 224. The ends portions 222 and 224 of the bars 104 are configured to be pivotally coupled with top portions of the posts 102. In some embodiments, the bars 104 are coupled with the posts 102 such that the end portions 222 and 224 of adjacent bars 104 overlap with each other on the top portion of each post 102 (e.g., intermediate posts 102B, 102C, and 102D in FIG. 2D) except for the end posts such as the posts 102A and 102E in FIG. 2D. Further, the bars 104 can be arranged at two different heights in an alternating manner. In the illustrated example, by way of example, for a first intermediate post 1028, the second end portion 224 of a first bar 104A is engaged with the first intermediate post 1028, and the first end portion 222 of a second bar 1048 is arranged above the second end portion 224 of the first bar 104 and engaged with the first intermediate post 1026. For a second intermediate post 102C adjacent the first intermediate post 1026, the first end portion 222 of a third bar 104C is engaged with the second intermediate post 102C, and the second end portion 224 of the second bar 1046 is arranged above the first end portion 222 of the third bar 104C and engaged with the second intermediate post 102C. In other embodiments, however, the bars 104 can be pivotally engaged with the posts 102 in other configurations.

The posts 102 include one or more sensor openings 230 through which sensor signals 209 can pass between the sensor sends 208 and the sensor receives 210. The posts 102 may have a plurality of sensor openings 230 that are arranged radially apart around the circumference of the posts 102 to accommodate different pivotal positions of the bars 104 with respect to the associated posts 102.

Figure 2F:
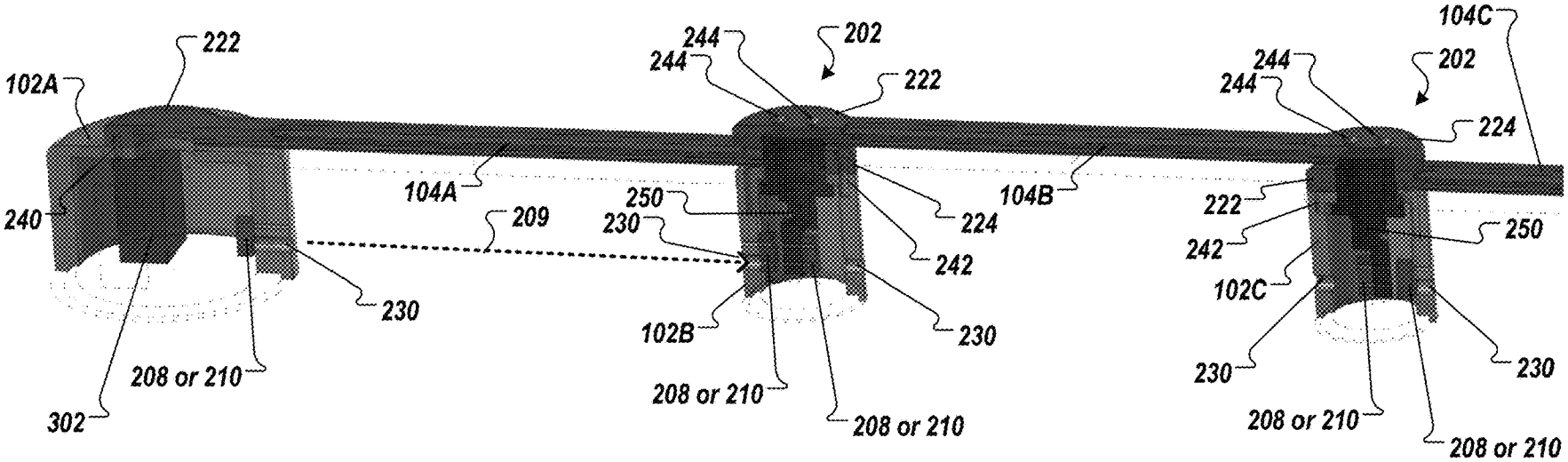
FIG. 2F is a cross sectional perspective view of example posts and bars in a straight line configuration.

Referring to FIG. 2F, at least one of the posts 102, such as an end post 102A, includes a controller 302 that can communicate with a computing device, such as a mobile device, through wireless and/or wired connection. The controller can further communicate with electronics included in each of the other posts 102, and/or with electronics included in each of the bars 104, via wireless and/or wired connection. An example of the controller 302 is described and illustrated in further details herein, for example with reference to FIG. 3.

Referring still to FIG. 2F, the bars 102 can be attached to the posts 102 in various configurations. In some embodiments, the bars 104 (including 104A, 1046, 104C, and 104D) include bars which are pivotally connected to their posts, and bars which are fixedly connected to their posts. The pivotal bars and the fixed bars can be alternatingly arranged along the posts 102 (including 102A, 102B, 102C, 102D, and 102E). In other embodiments, all of the bars 104 are pivotally connected to the posts 102.

In some embodiments, the first end portion 222 of the first bar 104A is fixedly connected to the top portion of the end post 102A using, such as, one or more fasteners 240. Further, the second end portion 224 of the first bar 104A is fixed connected to the top portion of the adjacent post 1026 using, such as, one or more fasteners 242. Thus, the end post 102A and the adjacent post 102B are fixedly arranged with respect to the first bar 104A.

Further, the second bar 1046 can be pivotally engaged with the posts 1026 and 102C at its opposite end portions 222 and 224. For example, the first end portion 222 of the second bar 1046 is pivotally arranged with respect to the post 102B. In some embodiments, the post 102B includes a core body 250 that is rotatably housed in the post 1026. The first end portion 222 of the second bar 1046 can be fixedly connected to the core body 250 of the post 1026 using, for example, one or more fasteners 244. Therefore, the second bar 1046 can be pivoted together with the core body 250 with respect to the post 1026. As described herein, in some embodiments, the first end portion 222 of the second bar 1046 is arranged above the second end portion 224 of the first bar 104A that is fixedly connected to the post 1026. The second end portion 224 of the first bar 104A can include an opening through which a top portion of the core body 250, which is housed in the post 1026, is inserted, so that the top portion of the core body 250 is fixedly connected to the first end portion 222 of the second bar 1046 while the second end portion 224 of the first bar 104A remains movable with respect to the core body 250 of the post 1026. Thus, the core body 250 of the post 102B and the second bar 104B can rotate together relative to the post 102B (and the first bar 104A fixed to the post 102B).

Similarly, the second end portion 224 of the second bar 104B is pivotally arranged with respect to the post 102C. In some embodiments, the post 1036 includes a core body 250 that is rotatably housed in the post 102C. The second end portion 224 of the second bar 1046 can be fixedly connected to the core body 250 of the post 102C using, for example, one or more fasteners 244. Therefore, the second bar 1046 can be pivoted together with the core body 250 with respect to the post 102C. As described herein, similarly to the first bar 104A that is fixed connected to the associated adjacent posts 102A and 102B at its opposite first and second end portions 222 and 224, the first end portion 222 of the third bar 104C is fixedly connected to the post 102C using, for example, one or more fasteners 242. The first end portion 222 of the third bar 104 can include an opening through which a top portion of the core body 250 housed in the post 102C is inserted. Thus, the second end portion 224 of the second bar 1046 can be arranged above the first end portion 222 of the third bar 104C and fixedly connected to the top portion of the core body 250, thereby enabling the core body 250 of the post 102C and the second bar 1046 rotate together relative to the post 102C (and the third bar 104C fixed to the post 102C).

In some embodiments, the sensors 208 and 210 can be mounted to the inner walls of the posts 102 and/or the core bodies 250. The sensors 208 and 210 that are mounted to the inner walls of the posts 102 are arranged to be aligned with the sensor openings 230 of the posts 102. The sensors 208 and 210 that are mounted to the core bodies 250 can be positioned at different radial angles as the core bodies 250 (together with the pivotal bars 104, such as the bar 1046) rotate with respect to the posts 102. The posts 102 include a plurality of sensor openings 230 for the sensors 208 and 210 mounted to the core bodies 250 so that the sensors 208 and 210 can be aligned with each of the sensor openings 230 at each of the different radial angles.

Figure 3:
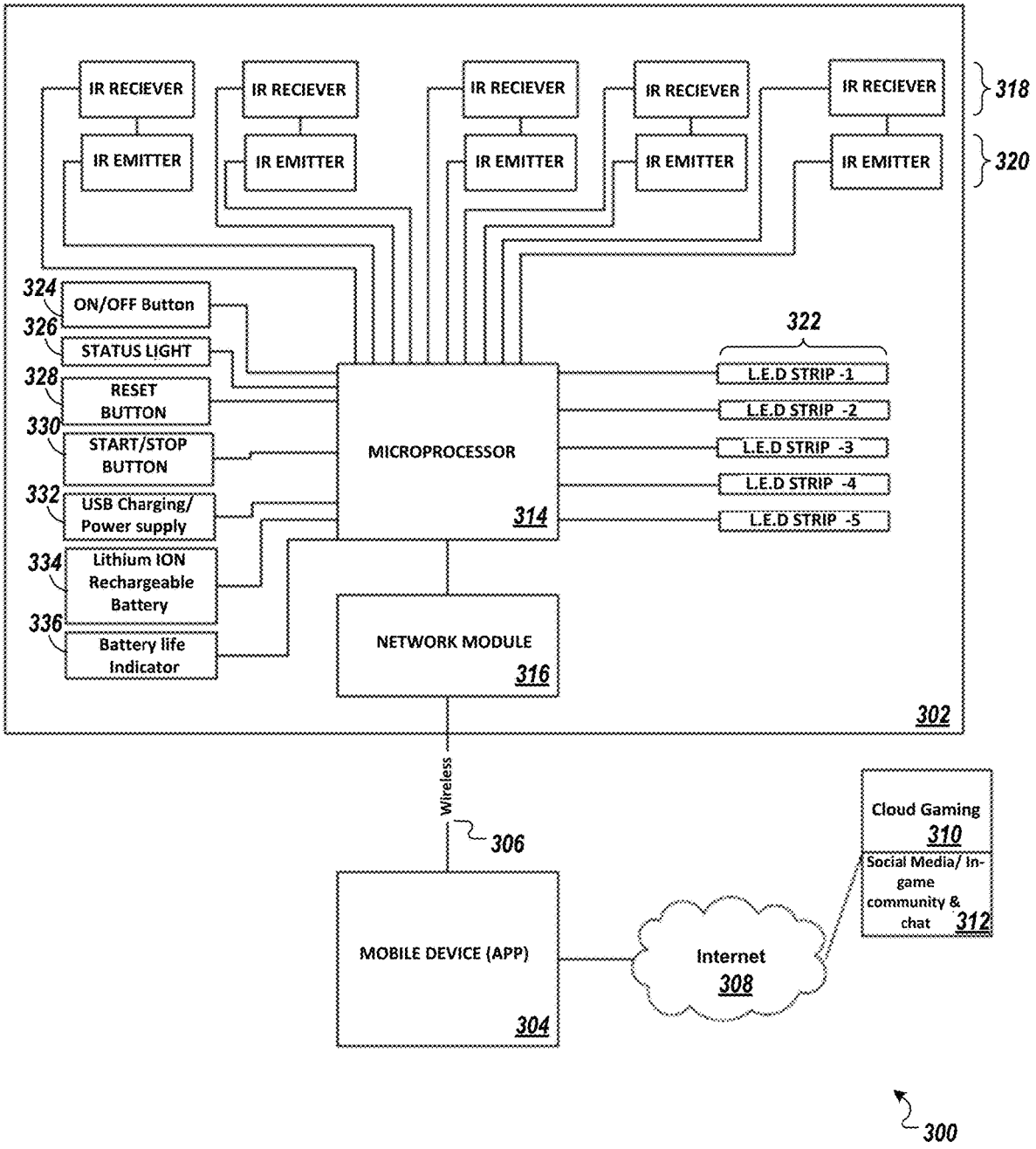
FIG. 3 is a schematic diagram of example components of the system.

FIG. 3 is a schematic diagram of example components of the system 100. A controller 302 can be contained inside one or more posts 102. The controller 302 can communicate with a mobile device 304 through a wireless connection 306. The mobile device 304 can include an application, such as the application 112. The mobile device 304 can communicate, using the network 308 (for example, including the Internet), with a cloud gaming system 310 and a social networking system 312.

A microprocessor 314 can serve as the central processing unit (CPU) of the controller 302. The microprocessor 314 can perform operations, including an analysis on the information received from the sensors, such as information associated with shots that are completed under the bars 104. The microprocessor can use a network module 316 to communicate wirelessly with the mobile device 304.

The controller 302 can include separate IR receivers 318 to receive information from respective ones of the sensor receives 210. The controller 302 can also include separate IR emitters 320 to send signals to respective ones of the sensor sends 208.

The controller 302 can interface with (and provide power to) light-emitting diode (LED) strips 322, where there is one LED strip 322 for each bar 104. The number of bars 104 and corresponding LED strips 322 can vary. For example, there can be 1, 2, 3, 4, 5, 6, 7, 8, 9, 10, 15, 20, and/or other numbers of bars 104 and corresponding LED strips 322. In some implementations, the number of bars 104 and corresponding LED strips 322 can be dynamically modified by the user, and the controller 302 can be configured to detect the addition and/or removal of bars 104 and LED strips 322 from the array. For example, each post can include a wireless and/or wired transceiver that is configured to pair with the controller 302 and to transmit IR sensor information to the controller 302.

In some embodiments, the controller 302 includes a wireless transceiver to wirelessly receive training sequences from a remote device (e.g., a mobile computing device and/or a remote server system), and to wirelessly transmit timing information to the remote device. The training sequences identify sequences of selective activations of the light strips that are controlled by the controller. The timing information is determined by the controller based on the signals from the sensors corresponding to the light strips activated during the training sequences.

The controller 302 can include an on/off button 324 so that, when the system is on, battery power is provided to the system. A status light 326 can indicate if the system is on. A reset button 328 can cause the system 100 to be reset to initial defaults, such as to abruptly end a current session. A start/stop button 330 (for example the start button 110) can start and stop training sessions. A universal serial bus (USB) charging/power supply 332 can provide a port for inserting a USB end of a power supply for charging a lithium ion rechargeable battery 334. A battery life indicator 336 can provide a display that indicates a relative remaining life of the lithium ion rechargeable battery 334.

Figure 4:
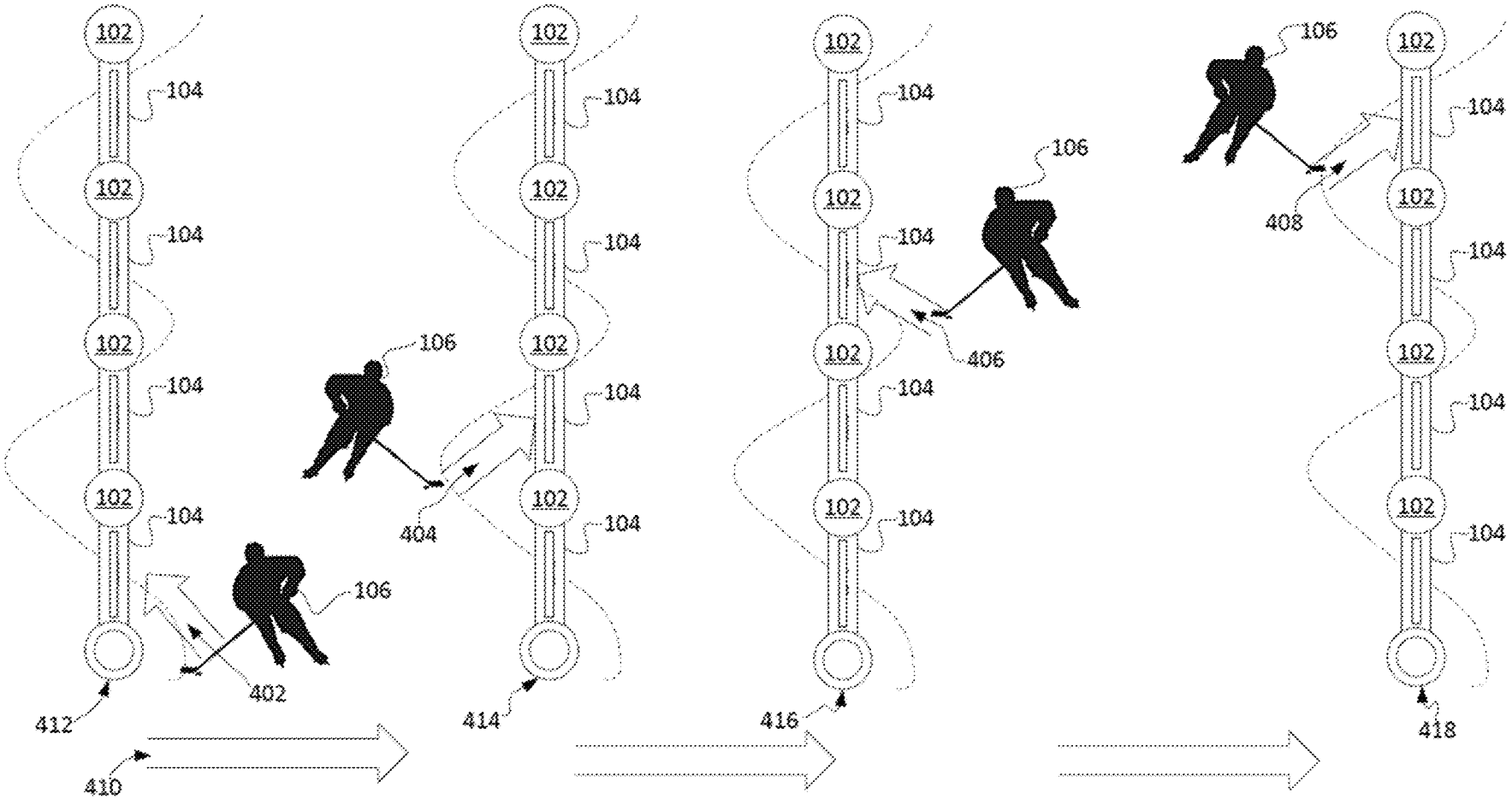
FIG. 4 is a sequence diagram showing an example sequence of shots over time.

FIG. 4 is a sequence diagram showing an example sequence of stickhandling moves 402-408 over time 410. For example, a player 106 can make a stickhandling move 402 at a time 412, followed by the a stickhandling move 404 at a time 414, followed by a stickhandling move 406 at a time 416, and then followed by a stickhandling move 408 at a time 418. The larger white arrows 402-408 can identify the light that is being illuminated as part of a training sequence to instruct the player to move the puck under the corresponding bar.

Figure 5:
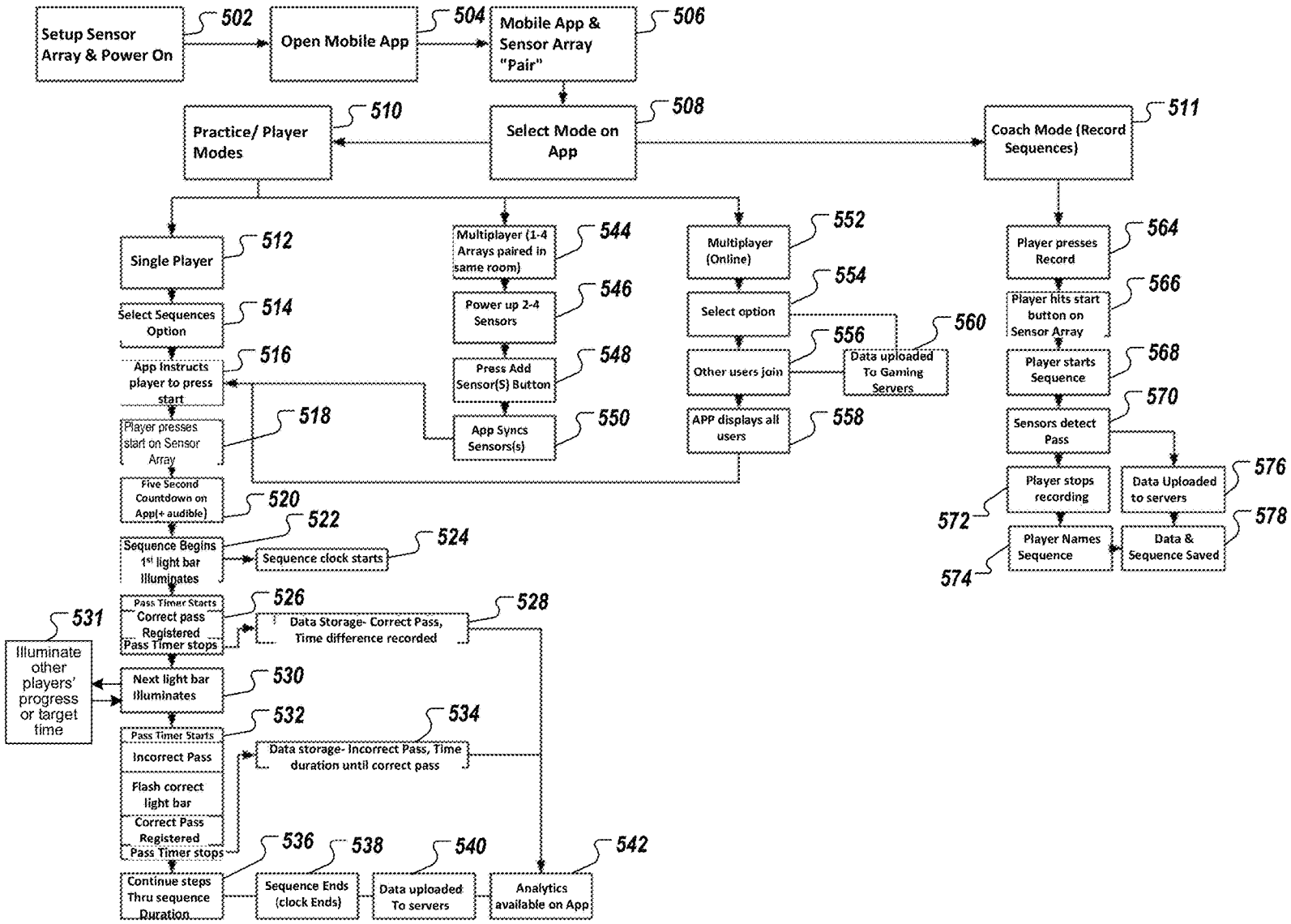
FIG. 5 is a diagram of example actions that can occur in the system.

FIG. 5 is a flowchart of an example training technique 500 that can be performed using, for example, the system 100. The technique 500 can be sequential and can be associated with practice (a left branch of the technique 500), competition (a center branch), and recording results (a right branch of the technique 500). During competition, angles set by the pivots 202 can be verified to be equal, so as to assure fair and accurate competition among teams or players. Angle alignment can be controlled or maintained by magnets, alignment bumps and groves, and various types of locks.

At 502, the sensor array of the system 100 is set up, and the system is powered up, such as by using the on/off button 324 on a post 102 that contains the controller 302. At 504, the mobile app is opened, such as by launching the application 112. At 506, the mobile app and the sensor array are paired (for example, establishing a communication), such as by using the Bluetooth connection. At 508, a mode on the app is selected, such as selecting the mode from menu in the application 112 that presents options for initiating practice/player modes 510 or a coaching mode 511 (for recording sequences).

In a single player mode, a single player 512 is identified, such as by providing a player ID (or using the player ID associated with the device 114). At 514, the player selects a sequence option, such as an order of bars 104 for which practice is to occur. At 516, the app instructs the player to press the start button. At 518, the player presses the start button 110 which causes the sensor array to prepare to begin sensing. At 520, the app provides an audible countdown (for example, five seconds), after which the practice session can start.

At 522, when the practice session (or a competitive session) starts, the sequence begins when the light on the first bar 104 illuminates, indicating the position for the first pass. Simultaneously, at 524, the clock starts. At 526, the pass timer starts, a correct pass (if completed) is registered, and then the pass timer stops. At 528, depending on the outcome of the pass, data storage occurs that stores information that includes the correct pass and a time difference, such as a difference between the start time and the completed pass time as captured by the sensors.

At 530, the next bar 104 is illuminated. At 531, lights are illuminated that indicate other players' progress. At 532, depending on the outcome of the pass, when an incorrect pass occurs (passing under the wrong bar 104), data storage occurs that stores information that includes the incorrect pass and a time difference, such as between the start time and the completed pass time as captured by the sensors. If a correct pass has occurred, then data storage is updated that includes the correct pass information. Either way, for a correct or an incorrect pass, the timer is stopped.

At 536, the sequence continues through the remaining expected passes. At 538, the sequence ends, and the clock for the entire sequence is stopped. At 540, data is uploaded to the servers. At 542, the analytics information is available on the application 112.

In a same-location competitive mode, at 544, multiple (for example, one to four) sensor arrays (contained in equal configurations of posts 102 and bars 104) can be pairs in a same location (for example, a same room or ice arena). At 546, the sensors of the multiple arrays are powered up. At 548, instructions are provided in the application 112 to press the add sensor(s) button. At 550, the sensors are synced (upon pressing the add sensor(s) button). The sequence can continue for each player at step 516, where each player is instructed to press the start button (where one start button pressed by a single player can be enough to initiate the competition).

In a different-location competitive mode, at 552, multiple players can be identified online. At 554, an option for multiple players is selected. At 556, other users can join the competition. At 558, the mobile applications 112 of each of the competing players displays information for all of the players in the competition. At 560, gaming information is uploaded to the servers. The sequence can continue for each player using steps such as steps 544-550 to start the competition, and at step 516, where each player is instructed to press the start button (where one start button pressed by a single player can be enough to initiate the competition).

In coaching mode 511, to begin the recording, at 564, the player presses a record button. At 566, the player presses the start button 110 on the sensor array. At 568, the player begins the sequence of passes. At 570, the sensors detect passes as they occur. At 572, the player stops recording. At 574, the player names the sequence (for example, using a mnemonic such as "first practice after the weekend"). At 576, as passes are detected, the recorded data is uploaded to the servers. At 578, additional data, including sequence ending data and the name of the sequence, are stored.

Figure 6B:
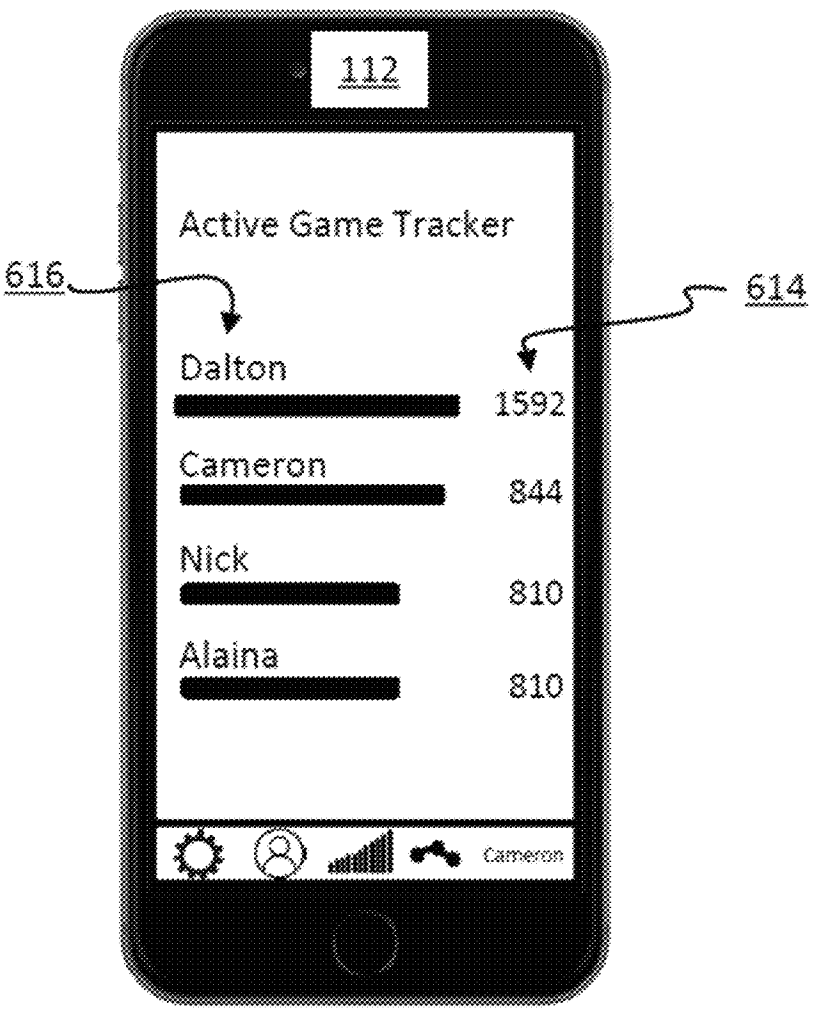
FIG. 6B is a screen shot of an example of the application displaying statistics.
Figure 6A:
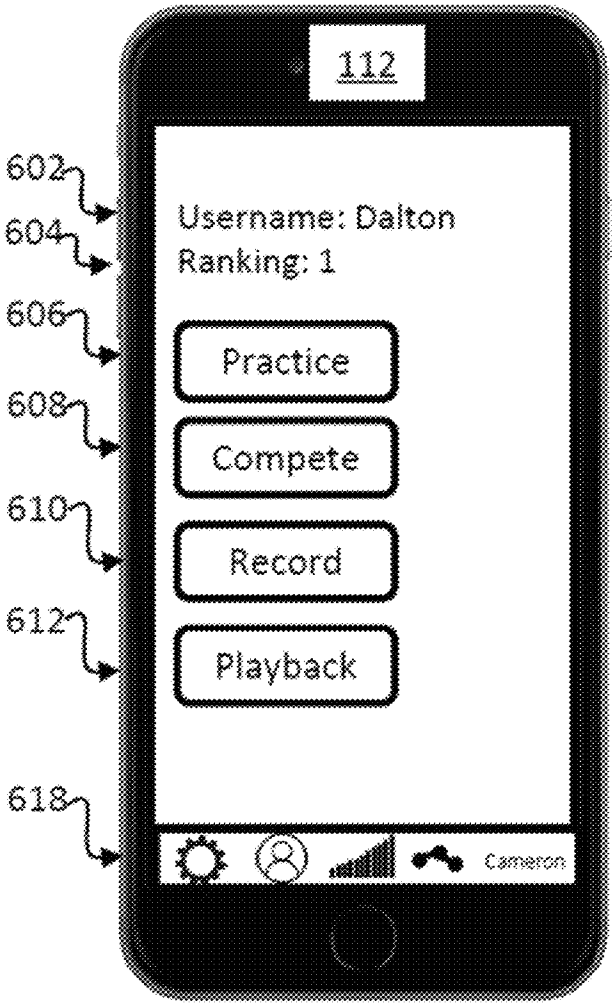
FIG. 6A is a screen shot of an example of the application displaying mode options.

FIG. 6A is a screen shot of an example of the application 112 displaying mode options. For example, modes selectable by a player having a name 602 and a ranking 604 can include a practice mode 606, a compete mode 608, a record mode 610, and a playback control 612. The playback control 612 can be used to play back a session for the player with the device 114 hosting the application 112 or another player, such as the highest-scoring player.

FIG. 6B is a screen shot of an example of the application 112 displaying statistics. For example, the statistics can include points 614 for players 616. Players 616 that are displayed can be limited to the players in the same room or same area (for example, ice arena).

The application 112 includes controls 618. A settings control can allow the user to define a user profile and other configuration settings for the application 112. A players control can allow the user to define and control the other players with which the player is to compete or perform other actions. A statistics control can provide the user with access to historical statistics as well as goal (for example, a goal to complete a session for a particular configuration in under N seconds). A configuration control can allow the user to set up and track configurations that the user has used or plans to use. Information and controls for players in the same room or area can automatically be synced, and an indication can be provided in the controls 618.

Figure 7A:
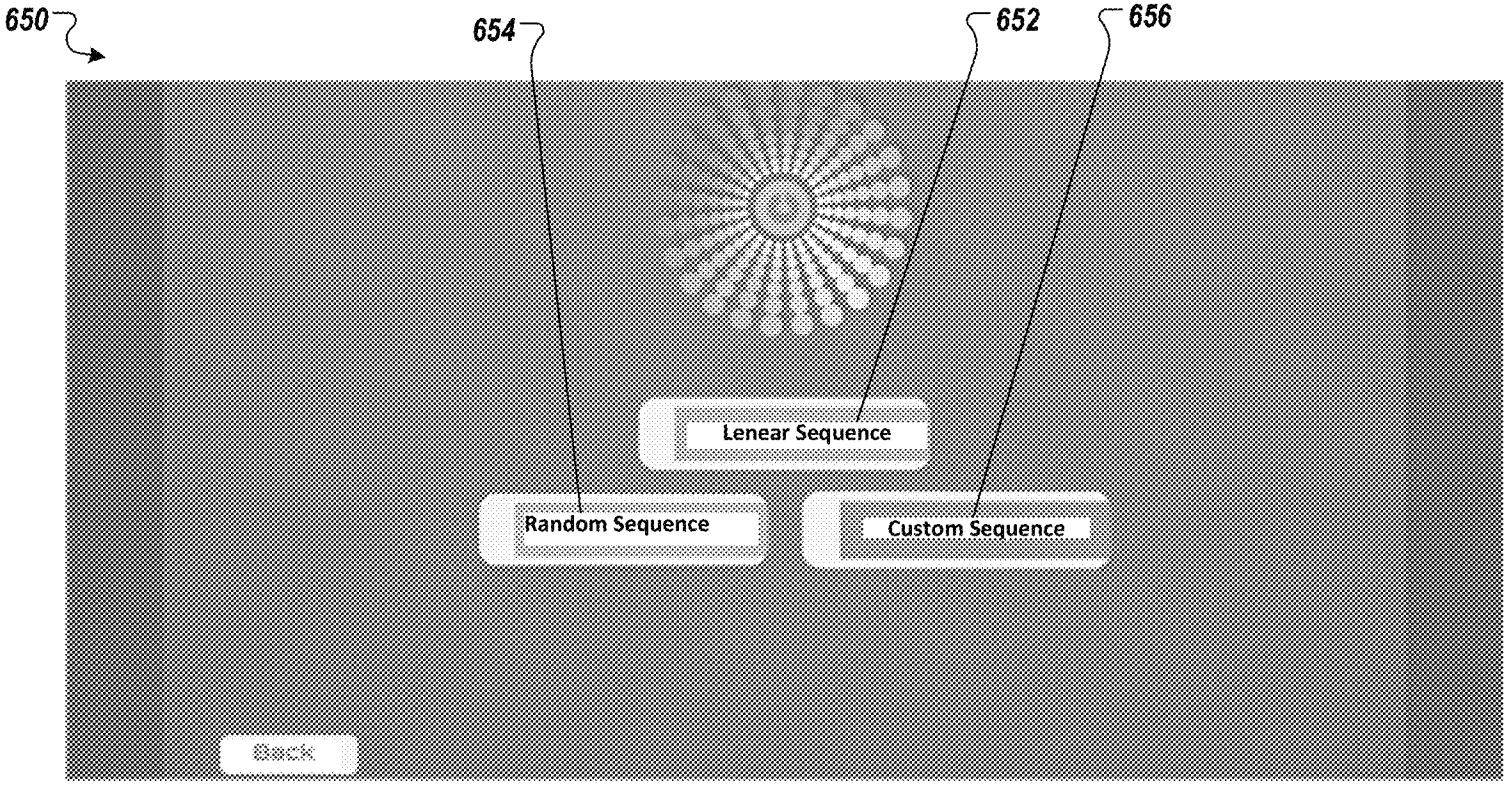
FIG. 7A is an example user interface of the application displaying different play modes.

FIG. 7A is an example user interface 650 of the application 112 that displays different play modes and enable a user to select one of them. Example play modes include a linear sequence 652, a random sequence 654, and a custom sequence 656. In the linear sequence play mode 652, the lights on the bars 104 are illuminated in a linear sequence so that a player linearly stick handles the puck under the bars 104 from one end to the other end. In the random sequence play mode 654, the lights on the bars 104 are randomly illuminated so that players can be instructed to perform non-linear stick handling sequences. The custom sequence mode 656 allows a user to set up the sequence of illumination of lights on the bars 104.

Figure 7B:
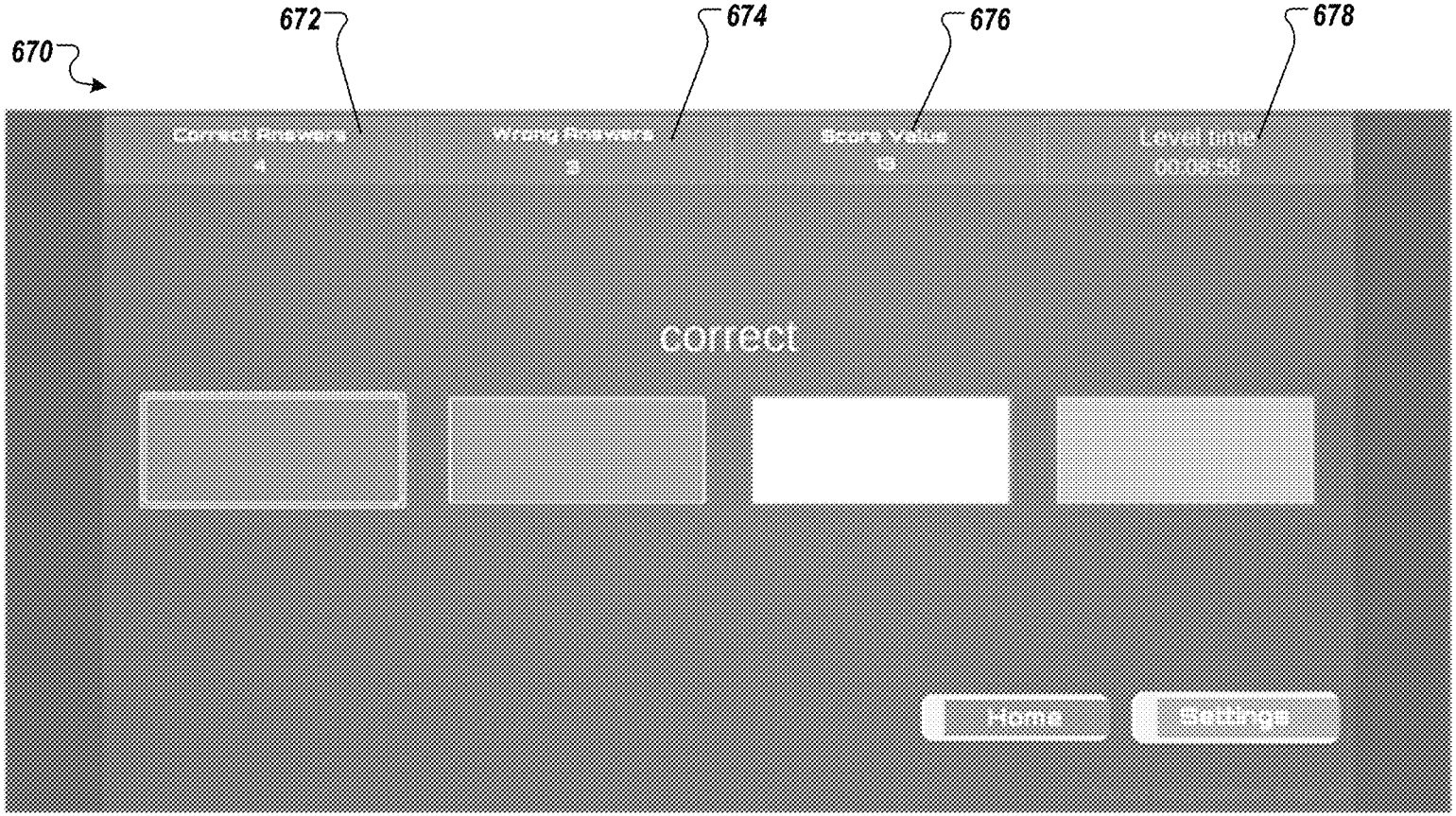
FIG. 7B is an example user interface of the application displaying statistics of a particular game.

FIG. 7B is an example user interface 670 of the application 112 that displays a scoreboard (or statistics) of a particular game. The scoreboard can include various pieces of information, such as correct answers 672, wrong answers 674, score value 676, and level time 678. The correct answers 672 show the number of the player's handling of the puck under each of the illuminating bars (or the illuminated bar in a predetermined period of time). The wrong answers 674 indicates the number of the player's failure to handle the puck under each of the illuminating bars (or the illuminated bar in a predetermined period of time). The score value 676 is a score calculated based at least in part on the correct answers 672, the wrong answers 674, and/or the level time 678. The level time 678 shows the time spent to complete the game.

Figure 7C:
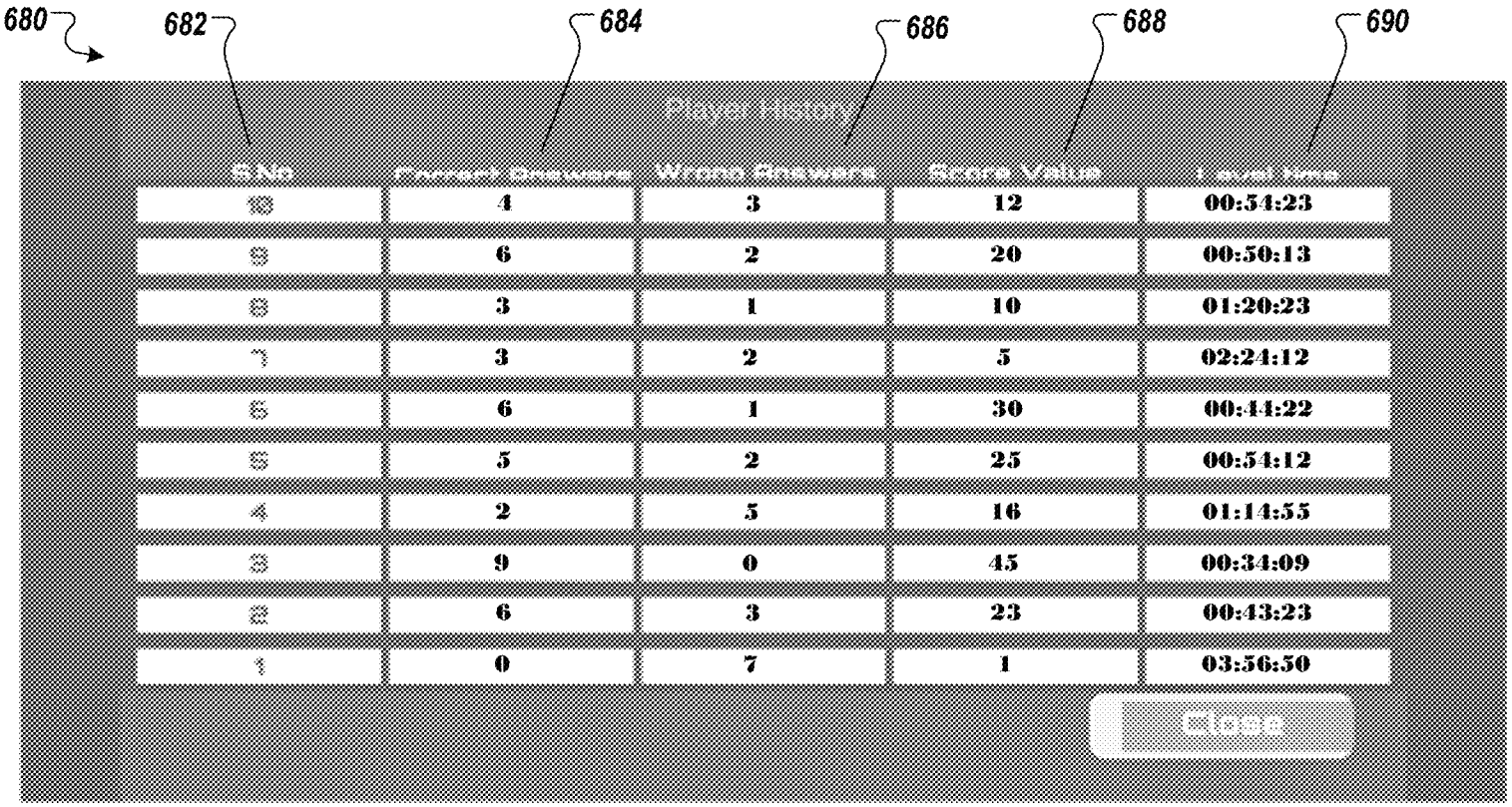
FIG. 7C is an example user interface of the application displaying statistics of a particular player.

FIG. 7C is an example user interface 680 of the application 112 that displays statistics of a particular player. The statistics can show various pieces of information, such as the number of games 682, correct answers 684 for each game, wrong answers 686 for each game, score values 688 for each game, and level time 690 for each game.

Figure 8:
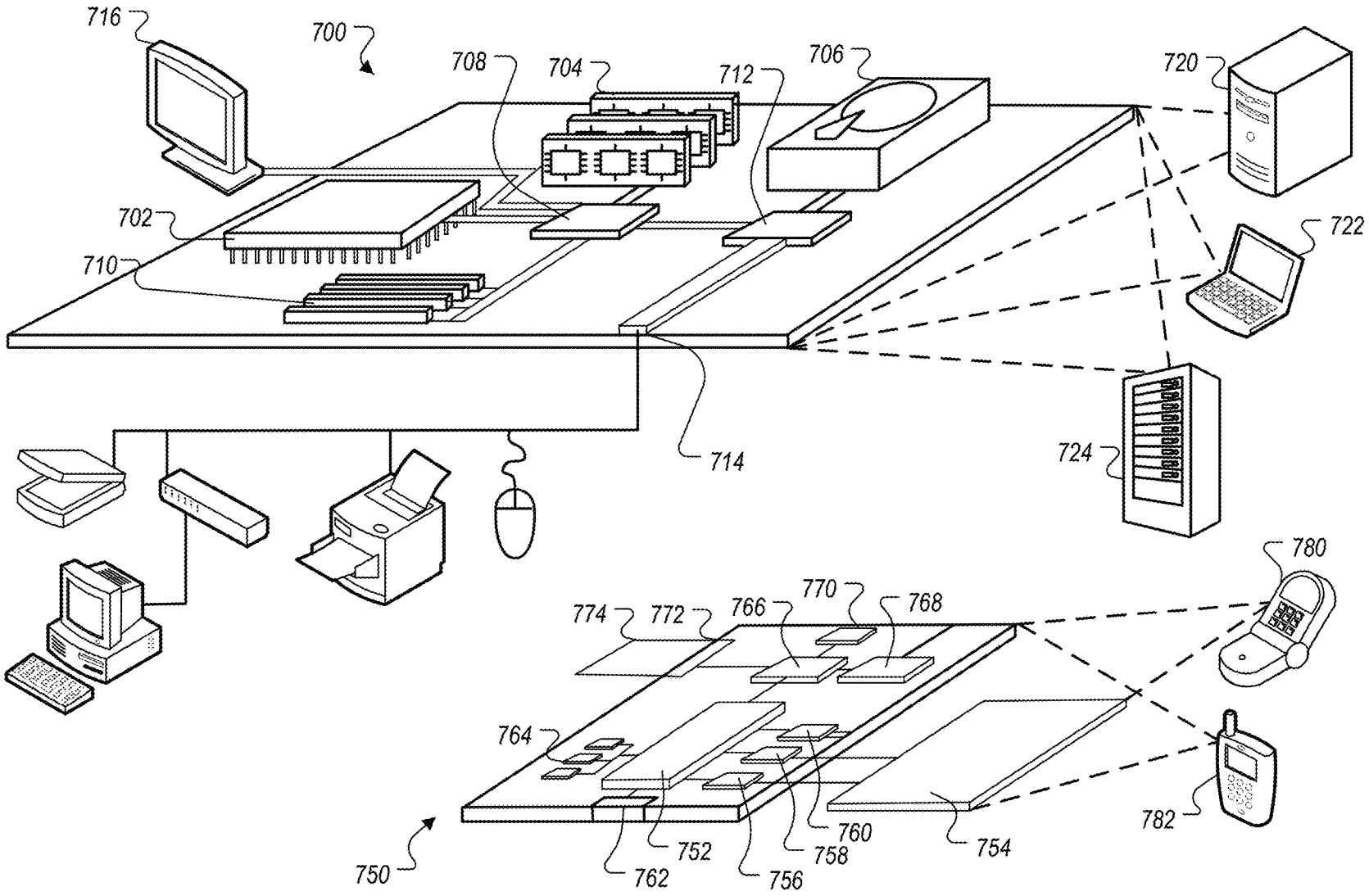
FIG. 8 is a block diagram of example computing devices that may be used to implement the systems and methods described in this document.

FIG. 8 is a block diagram of computing devices 700, 750 that may be used to implement the systems and methods described in this document, as either a client or as a server or plurality of servers. Computing device 700 is intended to represent various forms of digital computers, such as laptops, desktops, workstations, personal digital assistants, servers, blade servers, mainframes, and other appropriate computers. Computing device 750 is intended to represent various forms of mobile devices, such as personal digital assistants, cellular telephones, smartphones, and other similar computing devices. Additionally computing device 700 or 750 can include Universal Serial Bus (USB) flash drives. The USB flash drives may store operating systems and other applications. The USB flash drives can include input/output components, such as a wireless transmitter or USB connector that may be inserted into a USB port of another computing device. The components shown here, their connections and relationships, and their functions, are meant to be exemplary only, and are not meant to limit implementations described and/or claimed in this document.

Computing device 700 includes a processor 702, memory 704, a storage device 706, a high-speed interface 708 connecting to memory 704 and high-speed expansion ports 710, and a low speed interface 712 connecting to low speed bus 714 and storage device 706. Each of the components 702, 704, 706, 708, 710, and 712, are interconnected using various busses, and may be mounted on a common motherboard or in other manners as appropriate. The processor 702 can process instructions for execution within the computing device 700, including instructions stored in the memory 704 or on the storage device 706 to display graphical information for a GUI on an external input/output device, such as display 716 coupled to high speed interface 708. In other implementations, multiple processors and/or multiple buses may be used, as appropriate, along with multiple memories and types of memory. Also, multiple computing devices 700 may be connected, with each device providing portions of the necessary operations (e.g., as a server bank, a group of blade servers, or a multi-processor system).

The memory 704 stores information within the computing device 700. In one implementation, the memory 704 is a volatile memory unit or units. In another implementation, the memory 704 is a non-volatile memory unit or units. The memory 704 may also be another form of computer-readable medium, such as a magnetic or optical disk.

The storage device 706 is capable of providing mass storage for the computing device 700. In one implementation, the storage device 706 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 704, the storage device 706, or memory on processor 702.

The high speed controller 708 manages bandwidth-intensive operations for the computing device 700, while the low speed controller 712 manages lower bandwidth-intensive operations. Such allocation of functions is exemplary only. In one implementation, the high-speed controller 708 is coupled to memory 704, display 716 (e.g., through a graphics processor or accelerator), and to high-speed expansion ports 710, which may accept various expansion cards (not shown). In the implementation, low-speed controller 712 is coupled to storage device 706 and low-speed expansion port 714. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 700 may be implemented in a number of different forms, as shown in the figure. For example, it may be implemented as a standard server 720, or multiple times in a group of such servers. It may also be implemented as part of a rack server system 724. In addition, it may be implemented in a personal computer such as a laptop computer 722. Alternatively, components from computing device 700 may be combined with other components in a mobile device (not shown), such as device 750. Each of such devices may contain one or more of computing device 700, 750, and an entire system may be made up of multiple computing devices 700, 750 communicating with each other.

Computing device 750 includes a processor 752, memory 764, an input/output device such as a display 754, a communication interface 766, and a transceiver 768, among other components. The device 750 may also be provided with a storage device, such as a microdrive or other device, to provide additional storage. Each of the components 750, 752, 764, 754, 766, and 768, are interconnected using various buses, and several of the components may be mounted on a common motherboard or in other manners as appropriate.

The processor 752 can execute instructions within the computing device 750, including instructions stored in the memory 764. The processor may be implemented as a chipset of chips that include separate and multiple analog and digital processors. Additionally, the processor may be implemented using any of a number of architectures. For example, the processor 410 may be a CISC (Complex Instruction Set Computers) processor, a RISC (Reduced Instruction Set Computer) processor, or a MISC (Minimal Instruction Set Computer) processor. The processor may provide, for example, for coordination of the other components of the device 750, such as control of user interfaces, applications run by device 750, and wireless communication by device 750.

Processor 752 may communicate with a user through control interface 758 and display interface 756 coupled to a display 754. The display 754 may be, for example, a TFT (Thin-Film-Transistor Liquid Crystal Display) display or an OLED (Organic Light Emitting Diode) display, or other appropriate display technology. The display interface 756 may comprise appropriate circuitry for driving the display 754 to present graphical and other information to a user. The control interface 758 may receive commands from a user and convert them for submission to the processor 752. In addition, an external interface 762 may be provide in communication with processor 752, so as to enable near area communication of device 750 with other devices. External interface 762 may provide, for example, for wired communication in some implementations, or for wireless communication in other implementations, and multiple interfaces may also be used.

The memory 764 stores information within the computing device 750. The memory 764 can be implemented as one or more of a computer-readable medium or media, a volatile memory unit or units, or a non-volatile memory unit or units. Expansion memory 774 may also be provided and connected to device 750 through expansion interface 772, which may include, for example, a SIMM (Single In Line Memory Module) card interface. Such expansion memory 774 may provide extra storage space for device 750, or may also store applications or other information for device 750. Specifically, expansion memory 774 may include instructions to carry out or supplement the processes described above, and may include secure information also. Thus, for example, expansion memory 774 may be provide as a security module for device 750, and may be programmed with instructions that permit secure use of device 750. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 764, expansion memory 774, or memory on processor 752 that may be received, for example, over transceiver 768 or external interface 762.

Device 750 may communicate wirelessly through communication interface 766, which may include digital signal processing circuitry where necessary. Communication interface 766 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 768. In addition, short-range communication may occur, such as using a Bluetooth, WiFi, or other such transceiver (not shown). In addition, GPS (Global Positioning System) receiver module 770 may provide additional navigation- and location-related wireless data to device 750, which may be used as appropriate by applications running on device 750.

Device 750 may also communicate audibly using audio codec 760, which may receive spoken information from a user and convert it to usable digital information. Audio codec 760 may likewise generate audible sound for a user, such as through a speaker, e.g., in a handset of device 750. Such sound may include sound from voice telephone calls, may include recorded sound (e.g., voice messages, music files, etc.) and may also include sound generated by applications operating on device 750.

The computing device 750 may be implemented in a number of different forms, as shown in the figure. For example, it may be implemented as a cellular telephone 2080. It may also be implemented as part of a smartphone 2082, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), peer-to-peer networks (having ad-hoc or static members), grid computing infrastructures, and the Internet.

The computing system can include clients and servers. A client and server are generally remote from each other and typically interact through a communication network. The relationship of client and server arises by virtue of computer programs running on the respective computers and having a client-server relationship to each other.

Although a few implementations have been described in detail above, other modifications are possible. Moreover, other mechanisms for performing the systems and methods described in this document may be used. In addition, the logic flows depicted in the figures do not require the particular order shown, or sequential order, to achieve desirable results. Other steps may be provided, or steps may be eliminated, from the described flows, and other components may be added to, or removed from, the described systems. Accordingly, other implementations are within the scope of the following claims.

What is claimed is:

1. A hockey training apparatus comprising:

a plurality of posts;

a plurality of bars being supported by the posts, wherein the posts and bars are configured for an object to pass under each of the bars;

a plurality of sensors each configured to detect a presence adjacent each of the bars between adjacent posts or a passage of the object under each of the bars between adjacent posts;

a plurality of light strips disposed at the plurality of bars, respectively; and a controller that (i) controls the light strips to selectively illuminate one of the bars to indicate under which the object is to pass, (ii) receives a signal from one of the sensors that is associated with the one of the bars, the signal representative of the presence of the object adjacent the one of the bars or the passage of the object under the one of the bars, and (iii), based on the received signal, turn off the illuminated strip to indicate the object has passed under the one of the bars, wherein the controller is housed within one of the posts.

2. The hockey training apparatus of claim 1, wherein the controller randomly controls the light strips to selectively illuminate the light strips to indicate one of the bars under which the object is to pass, and turn off the illuminated strip to indicate the object has passed under the one of the bars.

3. The hockey training apparatus of claim 1, wherein the controller determines statistics based on signals transmitted from the plurality of sensors.

4. The hockey training apparatus of claim 1, further comprising:

a user interface configured to display the statistics of a player who uses the apparatus.

5. The hockey training apparatus of claim 4, wherein the statistics include at least one of a total number of passes, an elapsed time or a remaining time.

6. The hockey training apparatus of claim 1, wherein the controller controls the light strips based on a training sequence.

7. The hockey training apparatus of claim 1, wherein the controller stores the training sequence.

8. The hockey training apparatus of claim 7, wherein the controller is configured to communicate with a computing device, wherein the computing device transmits data indicative of the training sequence to the controller.

9. The hockey training apparatus of claim 8, wherein the controller identifies sequences of selective light strip activations based on the data indicative of the training sequence and controls the light strips based on the identified sequences of selective light strip activations.

10. The hockey training apparatus of claim 8, wherein the computing device includes a mobile computing device that is paired with the controller.

11. The hockey training apparatus of claim 8, further comprising: a server computing device that communicates with the mobile computing device.

12. The system of claim 1, wherein at least one of the bars are pivotally connected to at least one of the posts.

13. The system of claim 1, further comprising:

the posts includes housings respectively; and a core body rotatably housed in at least one of the housings of the posts.

14. The system of claim 13, wherein one of the posts is engaged with an end portion of a first bar of the bars and an end portion of a second bar of the bars adjacent the first bar, wherein the end portion of the first bar is fixedly connected to the core body rotatably housed in the at least one of the housings of the posts, and the end portion of the second bar is fixed connected to the at least one of the housings of the post and movably arranged with respect to the core body.

15. A method for controlling a hockey training apparatus, wherein the hockey training apparatus comprises:

a plurality of posts;

a plurality of bars being supported by the posts, wherein the posts and bars are configured for an object to pass under each of the bars;

a plurality of sensors each configured to detect a presence adjacent each of the bars between adjacent posts or a passage of the object under each of the bars between adjacent posts; and a plurality of light strips disposed at the plurality of bars, respectively;

the method comprising:

controlling the light strips to selectively illuminate one of the bars to indicate under which the object is to pass;

receiving a signal from one of the sensors that is associated with the one of the bars, the signal representative of the presence of the object adjacent the one of the bars or the passage of the object under the one of the bars; and based on the received signal, turning off the illuminated strip to indicate the object has passed under the one of the bars.

16. The method of claim 15, wherein controlling the light strips includes:

controlling the light strips to randomly illuminate the light strips to indicate one of the bars under which the object is to pass, and turn off the illuminated strip to indicate the object has passed under the one of the bars.

17. The method of claim 16, further comprising:

determining at least one of a total number of passes, an elapsed time, or a remaining time.

18. The method of claim 16, further comprising:

causing a user interface to present at least one of a total number of passes, an elapsed time, or a remaining time.

19. The method of claim 15, wherein controlling the light strips includes:

controlling the light strips based on a training sequence.

20. The method of claim 19, further comprising:

receiving the training sequence from a computing device.

* * * * *